United States Patent [19]

Neward

[11] Patent Number: 5,011,381

[45] **Date of Patent: * Apr. 30, 1991**

[54] HAND-HELD VACUUM PUMP VACUUM RELEASE

[76] Inventor: Theodore C. Neward, 9251 Archibald, Cucamonga, Calif. 91730

[ * ] Notice: The portion of the term of this patent subsequent to Feb. 21, 2006 has been disclaimed.

[21] Appl. No.: 411,332

[22] Filed: Sep. 22, 1989

[51] Int. Cl.[5] ..... F04B 41/00; F04B 39/10

[52] U.S. Cl. ..... 417/440; 417/569; 92/194

[58] Field of Search ..... 417/306, 435, 569, 440; 92/194; 251/235

[56] References Cited

U.S. PATENT DOCUMENTS

| | | | |
|---|---|---|---|
| 3,467,138 | 9/1969 | Haddix et al. | 251/235 |
| 3,612,722 | 10/1971 | Neward | 417/63 |
| 4,412,669 | 11/1983 | Hanyu et al. | 251/4 |
| 4,775,302 | 10/1988 | Neward | 417/440 |
| 4,806,084 | 2/1989 | Neward | 417/440 |

*Primary Examiner*—Leonard E. Smith

*Assistant Examiner*—Eugene L. Szczecina, Jr.

*Attorney, Agent, or Firm*—Lyon & Lyon

[57] ABSTRACT

There is disclosed herein a small and compact vacuum pump which serves as a portable vacuum source. The pump basically includes a cylinder coupled with a handle, and a piston in the cylinder coupled with another handle, along with a suitable valving assembly for allowing a vacuum to be drawn at an inlet of the pump. More particularly, there is also disclosed a vacuum release which can be attached to or form an integral part of the pump. The vacuum release comprises a closure member which can be moved upwardly and downwardly in a housing to close and open with respect to a valve seat and, respectively, allow a vacuum to be pulled or release the vacuum. The closure member is arranged to rotate and is biased by a suitable helical torsion spring to normally maintain the closure member in the closed position to therefore normally allow a vacuum to be drawn by the pump. The vacuum release can be operated by one finger of the pump operator's hand and against the force of the spring to enable the vacuum to be simply and easily released.

4 Claims, 1 Drawing Sheet

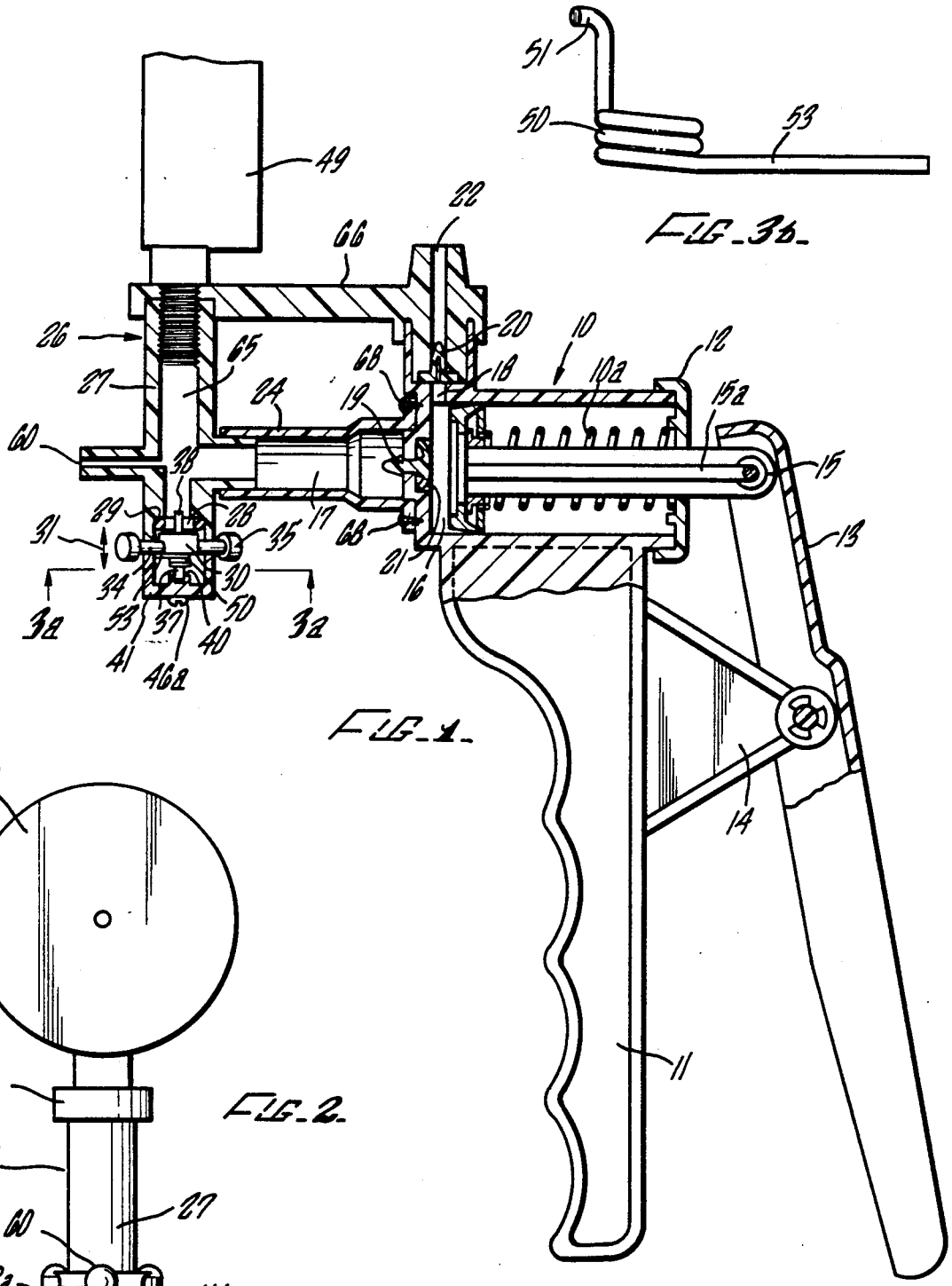
FIG. 1.
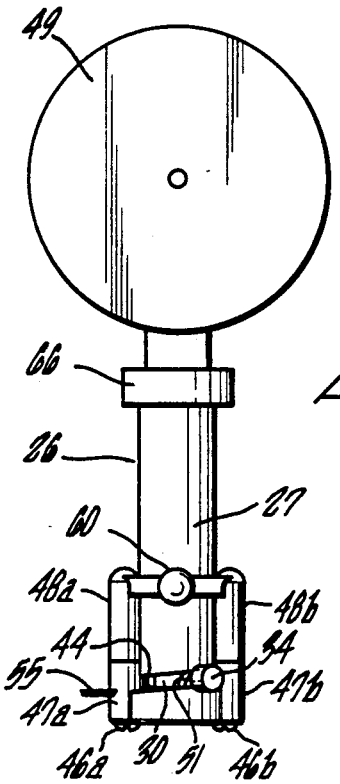
FIG. 2.
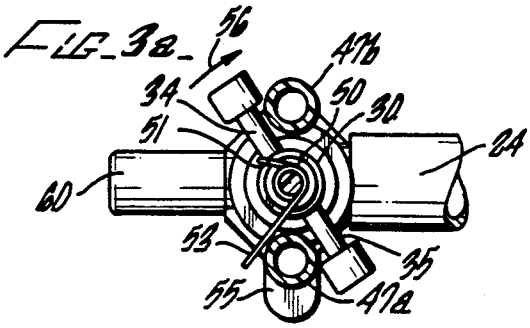
FIG. 3a.
FIG. 3b.

HAND-HELD VACUUM PUMP VACUUM RELEASE

BACKGROUND OF THE INVENTION

The present invention relates to the field of hand-held vacuum pumps, particularly of the type disclosed in U.S. Pat. Nos. 3,612,722, 4,775,302 and 4,806,084, by the present inventor Theodore C. Neward, the disclosures of which are incorporated herein by reference.

Vacuum pumps are generally useful whenever a vacuum is desired, for example, to provide suction. Many types of vacuum pumps have been devised, but they often suffer from such drawbacks as complexity, expense, excessive bulk, inability to pull a suitable vacuum, and the like. The vacuum pumps of the aforesaid patents have significantly solved the need for a vacuum pump which is simple, inexpensive, lightweight, compact and portable, and one which can pull a useful vacuum.

Such hand-held vacuum pumps are particularly useful in various industries, such as the automotive industry for vacuum system testing and repair, liquid sampling and the like. In the medical field, for example, such pumps have been used with vacuum extraction devices in childbirth, an aid for testing for throat blocking of choking victims, and other uses. Vacuum pumps manufactured according to the aforesaid patents have the ability to pull a vacuum of, for example, twenty-eight inches of mercury.

In many applications for such vacuum pumps it is particularly desirable to enable the vacuum which is developed by the pump to be easily and quickly released. Inasmuch as the hand-held vacuum pump is manually operated by hand, in many cases in the past it has been necessary to use the operator's second hand to operate a vacuum release mechanism that may be provided or used. As will be appreciated, this is cumbersome, especially when operating in a confined environment with limited maneuverability or when there are time restrictions. One solution to this problem is disclosed in the aforementioned U.S. Pat. No. 4,806,084 and which shows and describes a relatively simple vacuum release mechanism attached to the pump and which can be released relatively easily under finger control by the operator by a finger of the same hand that operates the pump. However, the improved vacuum release disclosed therein required that the operator position the release to the "on" position, or ensure that it was in this position, prior to operating the pump so that the vacuum can be drawn, and required that the release mechanism be manually returned by the operator to the "on" position after it was turned to the "off" position by the operator in releasing the vacuum. Thus, while this vacuum release facilitated one hand operation of the pump and one finger release of the vacuum (to the "off" or vacuum release position), it still was necessary to manually return the release to the "on" position, and thus sometimes could be cumbersome.

SUMMARY OF THE INVENTION

The present invention provides an improvement on the aforesaid vacuum pumps by enabling a vacuum to be easily obtained in a simple manner and to be quickly and simply released.

The present invention comprises a hand-held vacuum pump including a cylinder coupled with a handle, a piston in the cylinder coupled with another handle, along with a suitable valving assembly for allowing a vacuum to be drawn at an inlet of the pump. Downstream of the inlet is a vacuum release comprising a rotary member having an arm attached thereto to enable the same to be operated by one finger of the operator's hand, substantially as shown and described in U.S. Pat. No. 4,806,084.

The present invention involves an improvement to that form of rotary vacuum release wherein a torsion spring is provided to properly bias the moveable member of the release mechanism to an "on" position wherein a vacuum can be drawn by the pump. This arrangement maintains the release mechanism in the "on" position at all times, except when the operator moves the same to the "off" (or vacuum release) position. This is a relatively simple modification of the prior vacuum release, but one which significantly improves the function and operation of the prior vacuum release. In particular, with this arrangement the vacuum release port is closed or in the vacuum "on" position at all times, except when physically moved by the operator to release the vacuum. Thus, the pump and release assembly are ready to immediately draw a vacuum as soon as the pump is operated, in contrast to the prior release arrangement wherein the operator needed to physically move the release to the "on" (no release of vacuum) position and insure that it was in this position before commencing drawing a vacuum.

Accordingly, it is an object of the present invention to provide an improved hand-held vacuum pump.

Another object of this invention is to provide an improved vacuum release for a hand-held vacuum pump.

A further object of this invention is to provide a vacuum release which can be used for retrofitting or attachment to a hand-held vacuum pump.

BRIEF DESCRIPTION OF THE DRAWINGS

These and other objects of the present invention will become better understood through a consideration of the following description taken in conjunction with the drawings in which:

FIG. 1 is a side view showing a hand-held vacuum pump of the type shown and described in said aforesaid patents, and with an improved vacuum release according to the present invention coupled therewith;

FIG. 2 is a down-stream end view of the pump and vacuum release of FIG. 1;

FIG. 3*a* is a cross-sectional view taken along line 3*a*—3*a* of FIG. 1 and which shows further details of the vacuum release of the present invention; and FIG. 3*b* is a side view of a spring member of the vacuum release.

DETAILED DESCRIPTION OF THE INVENTION

Turning now to the drawings, a pump of the type disclosed in the aforesaid patents is shown which includes a cylinder 10 connected to a first fixed handle 11. The cylinder 10 includes a cap 12 covering one end thereof, and a second movable handle 13 is pivoted on a support 14 attached to the handle 11. The handle 13 has its upper end connected at 15 via a piston rod 15*a* to a piston 16 within the cylinder 10. The cylinder 10 has an inlet port 17 and exhaust port 18 connected to the opposite end of the cylinder 10 from the cap 12, and includes an umbrella valve 19 and duckbill valve 20 for allowing a vacuum to be drawn.

As will be apparent to those skilled in the art, squeezing the handles 11 and 13 together and releasing them causes the piston 16 to be reciprocated back and forth in the cylinder 10 under spring 10*a* tension as more fully described in U.S. Pat. No. 4,806,084 and the other patents, thereby causing a vacuum to be drawn at the inlet port 17. In doing this air is drawn through the port 17 past the umbrella valve 19 and through a port 21 into the cylinder 10 by retraction of the piston as the handles 11 and 13 move together, and air is exhausted from the cylinder 10 through the exhaust outlet 18, the duckbill valve 20 and port 22 as the piston 16 returns toward the outlet 18 as is more fully described in the aforesaid patents.

The inlet port 17 exists in a tube 24 connected with a vacuum release mechanism 26. The vacuum release mechanism 26 includes a housing 27 having a valve seat 28 about which there is located an O-ring 29. A rotatable closure or valve member 30 is moveable upwardly and downwardly as indicated by an arrow 31 to respectively seat with the O-ring 29 to hold the vacuum, or be spaced from the O-ring to release the vacuum as will be apparent from FIG. 1. This axial movement 31 of the closure member 30 is provided by rotary movement of the closure member 30 as is discussed below. The closure member 30 has two extending cam arms 34 and 35 with enlarged ends as shown and are operable by the index finger of the operator's hand which grips the handles 11 and 13 of the pump. The closure member 30 has longitudinal directed axles 37 and 38. The lower axle 37 rides in a bearing channel 40 in a cap 41, and the upper axle 38 extends upwardly through the O-ring 29. The cam arms 34 and 35 ride in a slot 44 which has a slight incline as best seen in FIG. 2 to allow the closure member 30 to be moved to the "on" (up to pull vacuum) or "off" (down to release vacuum) by a finger or fingers of the pump operator. The cap 41 is fastened by screws 46*a–b* through bosses 47*a–b* to the housing 27 at 48*a–b* as best seen in FIG. 2. A tab 55 can be molded in the housing 26 as best seen in FIGS. 2 and 3*a*. This tab can be labeled on the top (as seen in FIG. 2) with an "on" label to indicate that the vacuum is on when the arrows 34 and 35 are in the up position as seen in the Figures.

A vacuum gage 49 can be secured to the housing 27 and communicate via chamber 65 with the outlet port 60. Preferably, a support brace 66 is provided between the housing for the duckbill valve 20 at the end of the cylinder 10 and the vacuum release 26. The tube 24 preferably is secured by suitable adhesive to the housing 27 and forms a part of the vacuum release, and the same can be fastened to the cylinder 10 or pump body by suitable screw fasteners 68. This arrangement facilitates assembly and disassembly. The pump thusfar described is substantially identical to that disclosed in U.S. Pat. No. 4,808,084.

In accordance with the present invention, a torsion spring 50 is disposed about the lower axle 37 of the closure member 30, and has a first end 51 in the form of a hook which engages cam arm 34 and an arm 53 which engages or bears against boss 47*a*. Torsion spring 50 biases the arm 34 in the direction indicated by arrow 56 in FIG. 3*a* and thereby causes the arm 34 to ride up on the can surface 44 (note FIG. 2) to raise the closure member 30 so as to seal the top of the closure member 30 against the O-ring 29 and seat 28 and thereby turn "on" the vacuum pump (close the vacuum release) so as to allow the same to draw a vacuum. Then, after a suitable vacuum has been drawn and it is desired to release the same, the arm 35 can be simply contacted by the index finger of the pump user (assuming right handed operation for the arrangement as shown in the figures) and this arm 35 moved thereby rotating the closure member 30 away from the O-ring 29 and seat 28 thereby turning "off" the vacuum which opens the vacuum release and releases the vacuum from the container (not shown) attached to vacuum outlet port 60. With this arrangement, the closure member 30 is normally maintained in the upper position as indicated by arrow 31 in FIG. 1 and therefore is in the vacuum "on" (closed) position normally so that immediately upon picking up the pump to draw a vacuum, a vacuum can be drawn without requiring the vacuum release to be manipulated or repositioned as has been the case in the past. Additionally, once a vacuum has released, the closure member returns to the "on" position automatically so that a vacuum can be immediately drawn again.

The spring 50 preferably is made from 0.024 inch stainless spring wire, and the hook end 51 has a height of one-eighth inch from the intermediate coil of the spring, and has a one-sixteenth inch length hook end disposed at a forty five degree angle. The leg 53 is disposed at approximately ninety degree maximum angle from the hook end 51 and this leg preferably is approximately 0.412 inch long. The coil section of the spring preferably has an inside diameter of approximately 0.135 inch.

While embodiments of the present invention have been shown and described, various modifications may be made without departing from the scope of the present invention, and all such modifications and equivalents are intended to be covered.

What is claimed is:

1. A hand-held vacuum pump, comprising a cylinder for isolating a volume from the atmosphere and having an inlet port and an outlet port, biased piston means for drawing a vacuum through the inlet port of the cylinder and including a piston which can be moved in the cylinder, a handle assembly coupled with the cylinder and the piston means for moving the piston with respect to the cylinder, and a vacuum release valve communicating with the inlet port of the cylinder and including a housing having an opening therein forming a cam surface, and further including a closure member with a cam arm which engages said cam surface and which closure member is rotatable within the housing to cause the closure member to move toward a valve seat in the housing for closing the vacuum release valve and which is moveable away from the valve seat as the arm moves along the cam surface to open the vacuum release valve, and torsion spring means connected between said arm and said housing of the vacuum release valve for biasing said arm and closure member in a rotational direction to axially cause the closure member manually to engage the valve seat and thereby close the vacuum release.

2. The pump as in claim 1 wherein said housing of said vacuum release comprises first and second cam surfaces, and said closure member has first and second cam arms radially extending therefrom and respectively engaging said cam surfaces, said closure member having a pair of axles disclosed within said housing for rotation therein, a lower portion of said housing comprising a cap into which a lower axle of said closure member is journaled for rotation, and said spring is disposed about said lower axle.

3. A pump as in claim 1 wherein said arm is operable by a finger of the hand to be disposed about the handle assembly and substantially without removal of the hand from the handle assembly.

4. The pump as in claim 3 wherein said housing of said vacuum release comprises first and second cam surfaces, and said closure member has first and second cam arms radially extending therefrom and respectively engaging said cam surfaces, said closure member having a pair of axles disclosed within said housing for rotation therein, a lower portion of said housing comprising a cap into which a lower axle of said closure member is journaled for rotation, and said spring is disposed about said lower axle.

* * * * *